US006668415B2

(12) United States Patent
Röhrig

(10) Patent No.: US 6,668,415 B2
(45) Date of Patent: Dec. 30, 2003

(54) TOOTHBRUSH

(75) Inventor: Peter Röhrig, Vienna (AT)

(73) Assignee: Bamed AG, Altendorf (CH)

( * ) Notice: Subject to any disclaimer, the term of this patent is extended or adjusted under 35 U.S.C. 154(b) by 134 days.

(21) Appl. No.: 09/908,641

(22) Filed: Jul. 18, 2001

(65) Prior Publication Data

US 2003/0014825 A1 Jan. 23, 2003

(51) Int. Cl.[7] ..... A46B 9/04; A46B 17/00
(52) U.S. Cl. ..... 15/167.1; 15/246; 248/688
(58) Field of Search ..... 15/167.1, 246, 15/248.1; 401/131; 248/688

(56) References Cited

U.S. PATENT DOCUMENTS

| | | | | |
|---|---|---|---|---|
| 878,486 | A | | 2/1908 | Crowell |
| 1,501,020 | A | * | 7/1924 | Small |
| 3,968,950 | A | * | 7/1976 | Gallo |
| 5,875,516 | A | * | 3/1999 | Blue |
| 6,101,660 | A | * | 8/2000 | Mroczka |
| 6,134,790 | A | | 10/2000 | Watson |

FOREIGN PATENT DOCUMENTS

| | | |
|---|---|---|
| FR | 11 24772 | 7/1956 |
| GB | 2 343 565 | 4/2000 |
| WO | WO/01/06889 | 2/2001 |

OTHER PUBLICATIONS

EP Search Report, Dec. 10, 2002.

* cited by examiner

*Primary Examiner*—Randall E. Chin
(74) *Attorney, Agent, or Firm*—Abelman, Frayne & Schwab

(57) ABSTRACT

A toothbrush with a handle including a gripping zone and a connecting zone, and with a bristle portion following the connecting zone, wherein the handle has a stop part spaced from the bristle portion and extending at least substantially perpendicularly with respect to the longitudinal axis of the toothbrush so as to limit an introduction of the toothbrush in the buccal cavity.

22 Claims, 1 Drawing Sheet

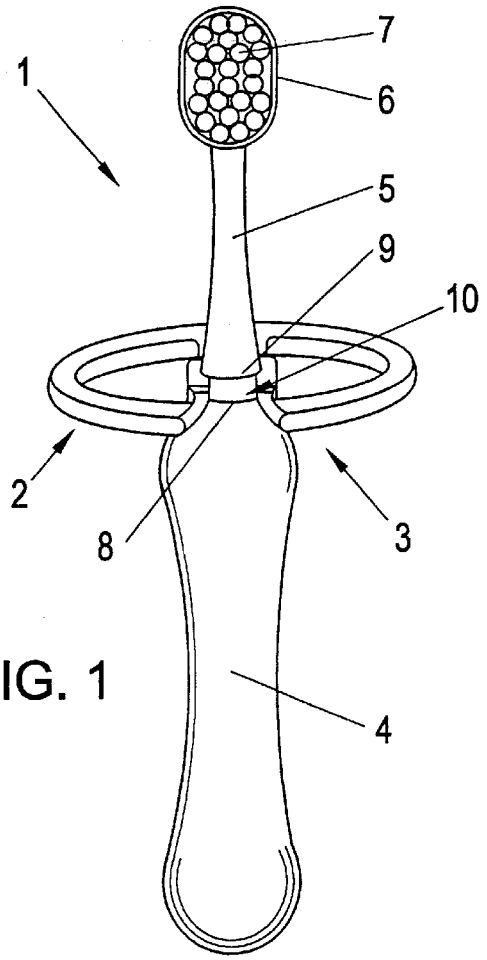
FIG. 1
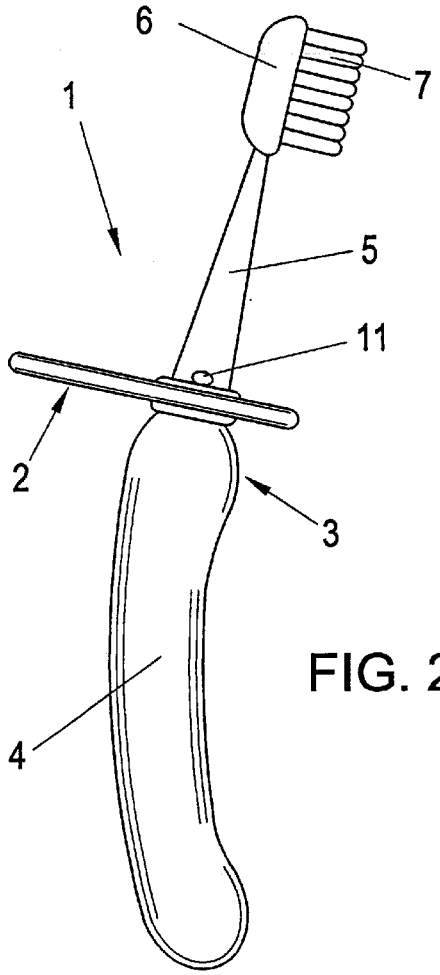
FIG. 2
FIG. 3
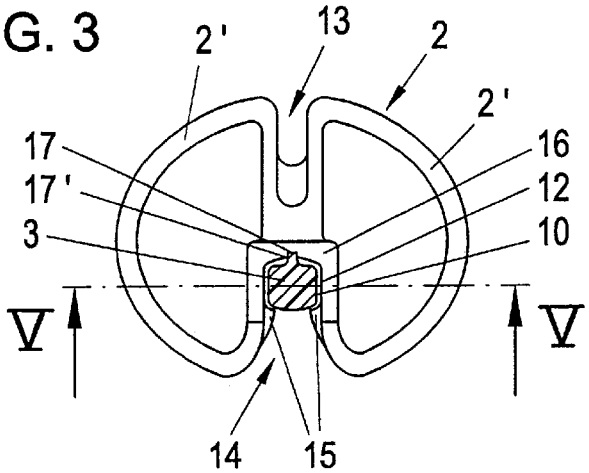
FIG. 4
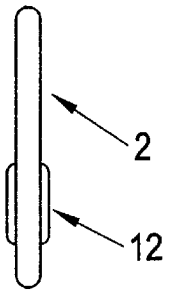
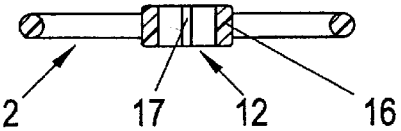
FIG. 5

TOOTHBRUSH

FIELD OF THE INVENTION

The invention relates to a toothbrush with a handle, the handle including a gripping zone and a connecting zone, and with a bristle portion joined to said connecting zone.

Moreover, the invention relates to a stop part for a tooth brush with a handle, the handle including a gripping zone and a connecting zone, and with a bristle portion joined to said connecting zone of said handle.

BACKGROUND OF THE INVENTION

Usually, toothbrushes are designed such that a more or less unlimited introduction of the toothbrush into the buccal cavity, or pharyngeal cavity, respectively, as such is possible. Particularly with children for whom the use of a toothbrush is something new or who are not very careful when using the toothbrush, this increases the risk of injury when the toothbrush is introduced too far into the buccal cavity, or pharyngeal cavity, respectively.

SUMMARY OF THE INVENTION

It is an object of this invention to provide a toothbrush which reduces the risk of an injury caused by an unrestricted introduction of the tooth brush into the pharyngeal cavity, or buccal cavity, respectively.

Furthermore, it is an object of the invention to provide a stop part which may be used in connection with a toothbrush to limit introduction of the toothbrush into the pharyngeal cavity, or buccal cavity, respectively.

According to the invention, the handle of the toothbrush has a stop part spaced from the bristle portion, and extending at least substantially perpendicularly to the longitudinal axis of the toothbrush, this stop part being provided to limit introduction of the toothbrush into the buccal cavity. With the assistance of this stop part which extends at least substantially perpendicular to the longitudinal axis of the toothbrush, the introduction of the toothbrush into the buccal cavity beyond the extent required for a suitable teeth cleaning procedure can be prevented, and thus injuries in the buccal cavity and in the pharyngeal cavity caused by the toothbrush being introduced too far thereinto can be prevented. Such a toothbrush with a stop member is particularly suitable for children who by far run the highest risk of an injury on account of the toothbrush being introduced too far into the buccal cavity.

To allow for an arbitrary use of the toothbrush with or without the stop part that reduces the risk of injury and increases its safety, the stop part may be designed to be slipped onto the handle.

In order to fix the stop part in the longitudinal direction of the toothbrush, the handle may have two cross-sectional enlargements spaced apart in longitudinal direction of the handle and acting as abutments, with the stop part being retained therebetween. In this manner it is easy to prevent slipping of the stop part in longitudinal direction on the toothbrush, particularly also during brushing of the teeth. Thus, it is ensured that the stop part will be provided at a defined distance from the bristle portion, such distance, on the one hand, allowing for an unimpeded brushing of teeth, while, on the other hand, preventing the bristle portion from being introduced too far into the buccal cavity.

To prevent rotation of the stop part on the toothbrush, the slip-on region of the handle provided between the two cross-sectional enlargements has a cross-section which is non-circular, e.g. substantially rectangular. It would also be conceivable for the cross-section to be approximately trapezoidal or elliptical.

To assist in orienting during a snapping on of the stop part on the handle so as to ensure the correct orientation of the stop part with respect to the bristles, a bead may be formed on the handle, said bead extending in the longitudinal direction of the toothbrush in the slip-on region thereof, which bead will engage in a corresponding groove provided in the stop part. However, the groove in the stop part is also advantageous in itself so as to facilitate an elastic widening of the stop part when it is slipped on, and so as to avoid the formation of fissures during such a procedure.

If a cross-sectional enlargement of the handle between the thicker gripping zone and the neck-shaped connecting zone is provided as an abutment, a contact of the stop part can be achieved easily by aid of the thicker gripping zone which, in any event, will be advantageous for ergonomical reasons.

To secure the stop part in longitudinal direction on the handle it is, on the other hand, advantageous if at least one knob or bead-shaped projection is provided on the handle, preferably in the connecting zone, to act as an abutment.

If removal of the stop part is not desired or not necessary, it may be preferred for reasons of production technology that the stop part is integrally formed with the toothbrush. Thus, it will be possible to produce the toothbrush in one working procedure, and particular devices for fixing the stop part in the longitudinal direction of the toothbrush or as safety means against rotation of the stop part can be left out.

To keep the extension of the stop part in the longitudinal direction of the toothbrush as small as possible so as to allow for the teeth to be brushed with as little impediment as possible, it is advantageous if the stop part is substantially plate-shaped or disc-shaped. It is just as well possible that the stop part is substantially annular, and this will advantageously allow for a design of the stop part which will be economical in terms of material used.

To enable brushing of the teeth with as little impediment as possible, while simultaneously reliably preventing the toothbrush from being introduced too far into the buccal cavity, it is advantageous if the stop part extends farther on the side of the handle which faces away from the bristles. In this way it is achieved that the stop part on the part of the handle facing the person's mouth side when brushing his/her teeth has only a very slight extension perpendicular to the longitudinal axis of the toothbrush. The essential extension of the stop part which prevents the toothbrush from being moved too far into the buccal cavity thus faces away from the part of the handle facing the mouth side, resulting in practically no impediment by the stop part during the cleaning procedure.

The stop part of the invention is preferably provided for as separate member which can be slipped onto the toothbrush handle in the connecting zone of the handle and, in the slipped-on state, extends at least substantially perpendicular to the longitudinal axis of the toothbrush so as to limit the introduction of the toothbrush in the buccal cavity. By such a stop part which can be slipped onto a conventional toothbrush, an excessive insertion of the toothbrush in the buccal cavity can be prevented, reducing the risk of injury when brushing teeth, particularly for children.

For a simple connection between the toothbrush and the stop part it is suitable if the stop part has a laterally open slip-on opening for slipping onto the handle. This slip-on procedure is particularly simplified if the slip-on opening widens towards the outer rim of the stop part, resulting in a widened introduction region into the slip-on opening.

To fasten the stop part on the toothbrush, it is suitable if the slip-on opening has oppositely arranged projecting noses for snapping the stop part onto the handle.

If the wall defining the slip-on opening has a groove and the stop part is slipped onto a tooth brush which has a bead fitting into the groove, it will be precisely defined in which orientation the stop part is to be slipped onto the handle, this being particularly important if the stop part is arranged out of center.

To reliably secure the stop part against rotation on the handle of the toothbrush, it is advantageous if the slip-on-opening is non-circular e.g. substantially rectangular.

For the stop part to extend substantially in the direction of the side facing away from the bristles when it is in its slipped-on position on the toothbrush, so that merely a slight extension of the stop part will be present transversely to the longitudinal axis of the toothbrush on its side facing the mouth opening during the cleaning procedure, it is suitable if the slip-on opening is provided out of center.

For a stable fastening of the stop part on the handle, avoiding wobbling of the stop part, it is advantageous if the region comprising the slip-on opening is thickened in hub-like manner as compared to the remaining stop part.

For the stop part to have as slight an extension in the direction of the longitudinal axis of the toothbrush as possible, so that any impediment during the cleaning procedure will be avoided, it is advantageous if the stop part is substantially plate or disc-shaped. For a material-saving design of the stop part it is suitable if the stop part is substantially annular, it being particularly advantageous if the stop part is double-bow-shaped by being made of two interconnected ring halves. In this manner, a resilient design of the stop part can be realized without any problems, in which the slip-on opening can widen somewhat when the stop part is snapped onto the toothbrush.

BRIEF DESCRIPTION OF THE DRAWINGS

The invention will now be explained in more detail by way of preferred exemplary embodiments illustrated in the drawings to which, however, it shall not be restricted. In detail, FIG. 1 shows a view of a toothbrush with a stop part slipped thereon, FIG. 2 shows a side view of a toothbrush slightly modified relative to that of FIG. 1 and also having a stop part;

FIG. 3 is a top view of a stop part according to FIGS. 1 and 2, with the toothbrush handle being shown in section;

FIG. 4 shows a side view of only the stop part, according to FIG. 3; and FIG. 5 shows a section through the stop part (without handle) according to line V—V of FIG. 3.

DESCRIPTION OF PREFERRED EXEMPLARY EMBODIMENTS

In FIG. 1, a toothbrush 1 is illustrated with a stop part or member 2 slipped thereon, as is considered as best mode embodiment at least at present. The toothbrush 1 has a handle 3 which comprises a gripping zone 4 proper and a connecting zone 5. The connecting zone 5 is followed by a bristle portion 6 carrying bristles 7. The stop part 2 is provided in the transition region between the connecting zone 5 and the gripping zone 4, an abutment 8 advantageously being formed due to the step-type enlargement of the cross-section between these two zones 5, 4. The abutment 8 prevents the stop part 2 from being shifted in the direction of the longitudinal axis of the toothbrush 1 towards the gripping zone 4. To secure the stop part 2 against shifting in the longitudinal direction of the toothbrush 1 towards the bristle portion 6, a bead-like projection is provided as a further abutment 9, spaced from the cross-sectional enlargement 8. Thus, a slip-on region 10 is defined between the two abutments 8, 9, and this slip-on region 10, moreover, is substantially rectangular in cross-section so as to provide for non-rotational fastening of the stop part 2, cf. also FIG. 3.

Thus, the stop part 2 is fixed at a defined distance from the bristle portion 6 in the longitudinal direction of the toothbrush 1. Accordingly, of the entire toothbrush 1, merely the bristle portion 6 including the connecting zone 5 can be introduced into the buccal cavity, or pharyngeal cavity, respectively, when brushing the teeth, since the stop part 2 on handle 3 prevents the toothbrush 1 from being introduced any farther in the buccal cavity due to its shape and size. Particularly with toothbrushes used by children this is an advantage because in this manner a risk of injury by a toothbrush introduced too far into the mouth is reduced.

In FIG. 2, a toothbrush 1 slightly modified relative to FIG. 1 is illustrated with a stop part 2 slipped thereon. Here it is visible that instead of a bead-like abutment 9, at least one projecting knob 11 is provided as an abutment in the direction towards the bristle portion 6.

In the exemplary embodiments illustrated in FIGS. 1 and 2, a clear separation between the gripping zone 4 and the connecting zone 5 due to the cross-sectional change forming the abutment 8 is visible. This, however, is not absolutely necessary. The stop part 2 may, of course, also be connected with the toothbrush 1 in any other suitable manner; the one abutment 8 may, e.g., also be formed by a bead, similar to abutment 9, or by discrete abutment-projections; on the other hand, the other abutment 9 may equally be formed by an enlargement of the cross-section towards the connecting zone 5, if this connecting zone 5 is relatively thick (and not thin and flexible, as in FIG. 1). It would also be conceivable to integrally form the stop part 2 and the handle 3 in one piece; then the knobs 11 of the illustration of FIG. 2 are omitted. Moreover, also a pin-and-hole connection between the stop part 2 and the handle 3 would be conceivable.

From FIG. 2 (and FIG. 3), moreover, it is clearly visible that the stop part 2 is designed such and slipped onto handle 3 that its extension is longer on the rear side of the toothbrush 1, facing away from the bristles 7, than on that side (front side) which features the bristles 7. This has the advantage that the stop part 2 will reliably prevent the toothbrush 1 from being introduced too far into the buccal cavity, yet will not interfere with the brushing procedure because of its relatively smaller extension on the front side.

FIG. 3 shows the stop part 2 in detail. Here it may be seen that the stop part 2 substantially has the form of a double-bow composed of two ring halves 2' which are interconnected in the middle. This double-bow shape which provides for a slip-on opening 12 diametrically opposite a recess 13 allows for an elastic widening of the stop part 2, which is advantageous for slipping the former on the handle 3. The slip-on opening 12, moreover, has an outwardly widening mouth region 14, whereby introduction of the handle 3 into the slip-on opening 12 is facilitated. For a retention of the stop part 2 on the handle 3 after it has been snapped on, two oppositely arranged, projecting noses 15 are provided. Just like the cross-section of the handle, the slip-on opening 12 is substantially rectangular, thereby preventing rotation of the stop part 2 on the handle 3.

In the front-side part of the wall 16 defining the slip-on opening 12, facing the center, a groove 17 is provided which serves to receive a bead 17' provided on the handle 3 at the rear side of the handle 3 facing away from the bristles, assisting in the correct slipping on of the stop part 2 on handle 3. Moreover, the groove 17 facilitates the elastic widening of stop part 2, avoiding fissures or cracks in the synthetic material of stop part 2.

From the side view of stop part 2 illustrated in FIG. 4 (without the handle) it also becomes visible—just as from FIG. 3—that the slip-on opening 12 is provided out of center such that in the slipped-on state of the stop part 2, the part with the larger extension comes to lie on the rear side of the toothbrush 1 which faces away from the bristles 7, and thus the stop part 2 will not interfere during brushing of the teeth.

In FIG. 5 it is visible in an axial section of the stop part 2 that the wall 16 defining the slip-on opening 12 is axially extended relative to the remaining stop part 2 in the manner of a hub, thus preventing tilting, or "wobbling", respectively, of the stop part 2 in its slipped-on state on the toothbrush 1.

What is claimed is:

1. A toothbrush comprising a one-piece handle including a gripping zone and a connecting zone, and a bristle portion comprising bristles and joined to said connecting zone, said handle further defining a longitudinal axis of the toothbrush, and including a separate stop part engaged onto said handle spaced from said bristle portion and extending at least substantially perpendicularly to the longitudinal axis of the toothbrush, said stop part being arranged to limit introduction of said toothbrush into a buccal cavity, said one-piece handle including two longitudinally spaced cross-sectional enlargements and serving as abutments, said stop part having a circumferential slip-on opening for mounting said stop part in frictional engagement on said handle between said two cross-sectional enlargements, whereby said stop part is securely retained in fixed relation to said handle.

2. A toothbrush as set forth in claim 1, wherein a slip-on region of non-circular cross-section is provided between said two cross-sectional enlargements of said handle.

3. A toothbrush as set forth in claim 2, wherein said non-circular cross-section of said slip-on region is substantially rectangular.

4. A toothbrush as set forth in claim 2, wherein said stop part has a slip-on region including a groove, said groove extending in the direction of the longitudinal axis of said toothbrush.

5. A toothbrush as set forth in claim 4, further comprising a bead provided in the slip-on region of said handle and extending in the direction of the longitudinal axis of said toothbrush.

6. A toothbrush as set forth in claim 1, wherein said connecting zone is neck-shaped and said gripping zone has a larger diameter, and one of said two cross-sectional enlargements of said handle defines an abutment between said larger diameter gripping zone and said neck-shaped connecting zone.

7. A toothbrush as set forth in claim 1, further comprising at least one projection provided on said handle and acting as an abutment.

8. A toothbrush as set forth in claim 7, wherein said at least one projection on said handle is provided in said connecting zone of said handle.

9. A toothbrush as set forth in claim 7, wherein said at least one projection on said handle is knob-shaped.

10. A toothbrush as set forth in claim 7, wherein said at least one projection on said handle is bead-shaped.

11. A toothbrush as set forth in claim 1 wherein said stop part is substantially plate-shaped.

12. A toothbrush as set forth in claim 1, wherein said stop part is substantially disc-shaped.

13. A toothbrush as set forth in claim 1, wherein said stop part is substantially annular.

14. A toothbrush as set forth in claim 1, wherein said handle has a side facing away from said bristles, and said stop part has a larger extension on that side of the handle facing away from said bristles.

15. A new toothbrush as set forth in claim 1, wherein said stop part has an outer periphery, and said slip-on opening widens towards said outer periphery of said stop part.

16. A new toothbrush as set forth in claim 1, wherein said slip-on opening has opposing projecting portions for snapping the stop part onto said handle of said toothbrush.

17. A new toothbrush as set forth in claim 1, wherein said slip-on opening has a wall defining said slip-on opening, a groove being provided in said wall.

18. A new toothbrush as set forth in claim 1, wherein said slip-on opening is non-circular.

19. A new toothbrush as set forth in claim 1, wherein said non-circular slip-on opening is substantially rectangular.

20. A new toothbrush as set forth in claim 1, wherein said slip-on opening is eccentrically arranged in said stop part.

21. A new toothbrush as set forth in claim 1, wherein the stop part has a hub-like thickened region around the slip-on opening.

22. A new toothbrush as set forth in claim 1, wherein said stop part is substantially bow shaped.

* * * * *